United States Patent [19]

Groshens

[11] 4,189,931

[45] Feb. 26, 1980

[54] COMPLEX STITCH FABRIC OF FLUFFY CHARACTER FOR LINING AND REINFORCING APPAREL AND METHOD OF MAKING SAME

[75] Inventor: Pierre Groshens, Peronne, France

[73] Assignee: Lainiere de Picardie, Peronne, France

[21] Appl. No.: 609,924

[22] Filed: Sep. 3, 1975

[30] Foreign Application Priority Data

Sep. 5, 1974 [FR] France ..... 74 30158

[51] Int. Cl.[2] ..... D04B 23/08

[52] U.S. Cl. ..... 66/193

[58] Field of Search ..... 66/84 A, 190–195

[56] References Cited

U.S. PATENT DOCUMENTS

| | | | |
|---|---|---|---|
| 2,247,092 | 6/1941 | Klumpp et al. | 66/84 |
| 2,696,723 | 12/1954 | Frith | 66/194 |
| 3,756,043 | 9/1973 | Kemter | 66/84 A |

OTHER PUBLICATIONS

Paling, D. F., "Warp Knitting Technology", 2nd Ed. 1965, Columbine, London England, pp. 172–173.

*Primary Examiner*—Ronald Feldbaum
*Attorney, Agent, or Firm*—Edwin E. Greigg

[57] ABSTRACT

A warp knit fabric and method of making it wherein said fabric which is adapted to constitute reinforcing plastrons for apparel is generally constituted by a stitch fabric having, on the one hand, a sheet of mutually parallel reinforcing yarns giving the fabric the required wiry properties and, on the other hand, a sheet of napped or roughened yarns which gives one face of the fabric adhering properties with respect to the fabric of the apparel or to its lining and, simultaneously, a light volume effect which provides a "fuller hand" of the frontal portion of the apparel thus replacing the conventionally attached felt-like layer.

3 Claims, 1 Drawing Figure

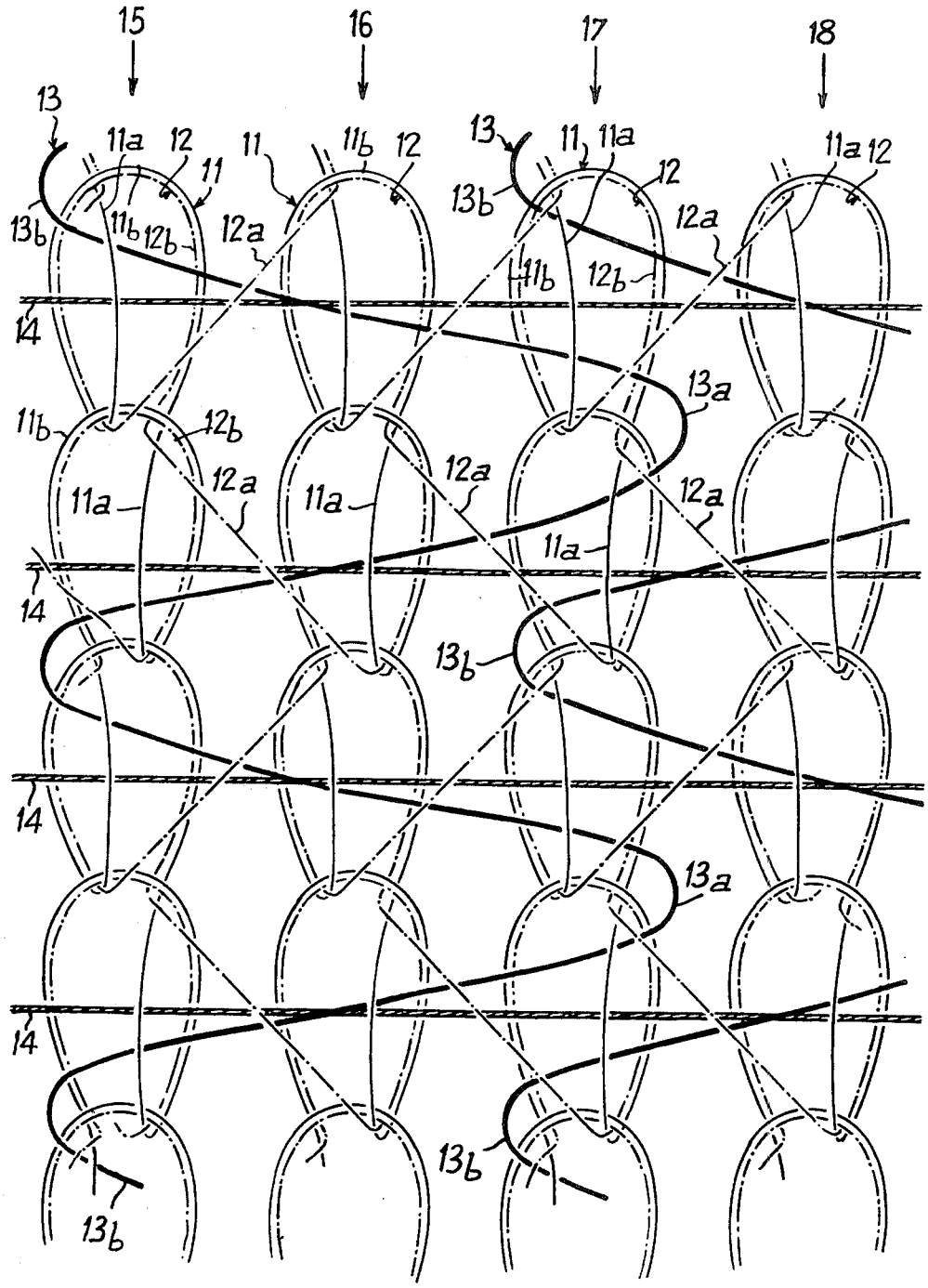
15
16
17
18
13
11a
12
11
11b
12
13
11
11a
12
11a
12
13b
11b
12b
12a
13b
12a
11b
12b
14
13a
11b
12b
12a
12a
12a
11a
11a
11a
14
13b
14
13a
14
13b
13b

COMPLEX STITCH FABRIC OF FLUFFY CHARACTER FOR LINING AND REINFORCING APPAREL AND METHOD OF MAKING SAME

A great variety of apparel has, in the chest area, a reinforcing plastron currently simply designated as "plastron" which serves the purpose of ensuring a correct chestline.

For the purpose of accomplishing the above result, the fabrics—generally designated as "horsehair fabric'-'—for the manufacture of plastrons are made of yarns which are wiry to a significant degree and which are spun, for example, totally or in part, of an animal hair, such as goat hair or horsehair. The hair yarns may be positioned either as warp or weft or warp and weft, dependent upon the results to be accomplished.

The present-day fashion tends to be generally oriented towards an overall lightening of apparel, particularly apparel worn in summer and towards an increased suppleness (flexibility) to render them more comfortable for wear.

The above-outlined tendency gives incentive to a search for solutions resulting in reinforcing fabrics (such as those forming linings and plastrons for the chest area) which are light and pliant, while preserving their property of wiriness in the fabric where it is necessary to provide, for example, in the front part of a jacket, a certain arched line and a sufficient body.

Such an object, however, can be obtained only in a very imperfect manner with those fabrics for linings and for plastrons which are manufactured according to a conventional method of weaving linen fabric or similar material on a weaving loom.

In fact, in such fabrics, for the purpose of accomplishing the above-outlined lightening and the increased pliability in one direction of the fabric, there are utilized warp yarns that are as thin as possible and that are made for example of spun or synthetic mono-filament yarn. The conventional weaving looms, however, do not allow the use of a yarn below a certain diameter; otherwise, there will appear the significant risk of yarn breakage. Further, the fabric will be excessively loose and will have no "body" whatever, because of the much too fine sheet of the warp yarns and their correlative pliability which does not permit to effect a sufficiently narrow connection between them and the reinforcing yarns which are highly wiry and which have a relatively large diameter. These latter yarns are disposed as wefts and are constituted, for example either by spun animal hair or mane or by continuous synthetic mono-filaments or multi-filaments.

Thus, if one wishes to manufacture a reinforcing fabric which is to be light and pliable in the direction of warp, it is necessary not only to reduce the weight, that is, to reduce the diameter of the warp yarn, but also to effect a similar reduction of the weft yarns which leads to a reduction of their wiry properties. Thus, it is obviously desirable that the lightening of the reinforcing fabric not be effected to the detriment of its wiry qualities which ensure that the chestline of the apparel is maintained.

The reinforcing fabric described below remedies the above-outlined disadvantages and it is characterized in that the sheet of the warp yarns are in the form of a knit sheet or knit fabric base, while each weft yarn is, by virtue of known operation on a knitting loom, inserted into the knit fabric base at the moment of forming of successive stitch rows or courses of the latter.

According to a preferred embodiment, the knit fabric is of the "warp knit fabric" type and the weft yarns are inserted between the stitch loop sheet and the connecting yarns lengths which tie together the stitch columns or wales and/or the successive stitches of the same column or wale.

The manufacture of the fabric is performed on a knitting loom of the "warp loom" type with weft insertion and one may work without difficulty with extremely thin yarns which constitute the knit base. Such yarns could not be used on a weaving loom. In contradistinction, a large diameter, of equal fabric weight, may be preserved for the weft yarns which thus keep entirely their wiry properties.

Thus, since the warp yarns can be extremely fine, the fabric acquires an increased pliability in the "warp direction" which is a desideratum as was explained above.

Further, it is to be noted that it is an essential characteristic of the industrial product constituted by the reinforcing fabric designed according to the invention that the warp yarns that constitute the knit base each form, after making each stitch row, a true knot around the relatively rigid and large-diameter weft yarns. Notably, this configuration has two significant and unexpected results. Thus:

On the one hand, these knots constitute around the weft yarn which they tie and with which they cooperate, a true articulation which determines, with respect to the two adjacent weft yarns and even with respect to yarns of equal diameter, a connection which is much more supple than linen fabric manufactured on conventional weaving looms. This characteristic is due probably to the fact that in the conventional linen fabric the warp yarn has an undulation which deviates only slightly from a straight line and thus does not give the fabric any prestress which would contribute to its flexibility. In contradistinction, the interconnection of two stitch rows constitutes a true articulation between yarns which, in addition, have undergone significant flexing stresses.

On the other hand, the same knots, by the tying action which they exert on the weft yarns, form, between the latter and the knit base, a very efficient connection which prevents all relative slippage and gives the fabric an excellent body regardless of the fineness of the yarn forming the knitted base. All elements of the fabric are, while preserving the above-outlined articulation effect, firmly maintained in their relative position, and the cohesion of the stitch fabric is increased by the existence of connecting yarn lengths tying together the adjacent stitch columns. In contradistinction, and as it was discussed above, the use of very thin warp yarns in a weaving loom results in fabrics which do not have the necessary cohesion and body unless the weft is relatively rigid and wiry and has a large diameter.

It is further to be noted that to the above-outlined advantages one should add, on the one hand, that the manufacturing speed of the fabric according to the invention is significantly higher than it is possible on conventional weaving looms, and the manufacturing, in case of great widths, is without additional complications on the knitting loom and, on the other hand, with respect to a manufacture on weaving looms, there has been experienced a significant decrease in the number of malfunctionings.

Furthermore, in order to enhance the adherence of the reinforcing fabric according to the invention to the fabric proper of the apparel or to its lining, and in order to give a light "volume" effect to the front part of the apparel, napping or roughening tests have been made of the knitted fabric as defined above in order to dispense with the felt layer usually sewn to the plastron for this purpose. It was found, however, that the results were not satisfactory, notably because the weft formed of natural yarns for the purpose to give the fabric a certain wiry property, lost one part of its wiry nature as a result of the napping or roughening operation.

In order to provide a remedy for the above-outlined disadvantage, it is proposed, according to the invention, to provide a stitch fabric, particularly for the manufacture of reinforcing plastrons for apparel which has, as described above, the knit base and the sheet of the mutually parallel reinforcing yarns designated here as "long weft yarns" inserted in the knit base during its manufacture and extending substantially rectilinearly in the thus constituted knit sheet, and in addition, has a plurality of yarns designated here as "inlaid warp yarns" adapted to be napped. The latter are inserted into the knit base and have a strongly undulating course. Each above-noted yarn passes, viewing one side of the knit base, above the stitch loop and above the long weft yarn and under the connecting yarn lengths which tie together the stitch columns and/or the successive stitches of the same column.

In accordance with a preferred embodiment, the long weft yarns extend between the sheet formed of the stitch loops and the sheet constituted by the inlaid warp yarns and are oriented transversely to the manufacturing direction of the fabric. The inlaid warp yarns extend in the general manufacturing direction of the fabric whereas their undulations extend transversely to this direction and above a plurality of stitch columns.

The invention will be well understood upon reading the description below in conjunction with the drawing in which:

The sole FIGURE represents in a schematic manner one portion of the fabric according to the invention.

In the FIGURE, 11 and 12 designate the yarns of stitch texture, while it is noted that in the example illustrated, the base fabric is a knit material of the "warp knit" type. The yarns 11 and 12 are, in principle, relatively thin or very thin with respect to the other yarns which will be discussed later.

In view of the pattern of the knit base illustrated, it is to be understood that the number of yarns 11 and the number of yarns 12 each equal the number of stitch columns; these columns are designated with reference numerals 15 to 18.

In each stitch column, the stitches of each successive row are tied to one another, on the one hand, by connecting portions 11*a* of the yarn 11 which tie together two consecutive stitches and, on the other hand, by connecting portions 12*a* (or "forward") of the yarn 12 which have a zig-zag course between two adjacent stitch columns. The above-described knit fabric is made on a known loom designated as "warp loom with weft insertion" which permits the insertion, between the yarns of the knit fabric proper, of several non-stitch yarns.

According to the invention there is thus inserted into the knit fabric, on the one hand, "long weft" yarns which have substantial wiry properties and are made, for example, of animal hair or of discontinuous synthetic or artificial fiber or by a continuous mono-filament or multi-filament or spun yarn having a certain wiry property, and, on the other hand, inlaid warp yarns which are adapted to be submitted to napping or abrading to thus give the fabric (in the example, on one of its faces) a slightly felted surface which enhances adherence to an adjacent fabric layer, while at the same time giving the entire assembly the effect of a light volume, that is, a "fuller hand" to certain portion of the apparel which, in general, is the front portion thereof.

It is to be noted that in view of the respective functions attributed to them, the yarns of inlaid warp and, in principle, also the yarns of long weft, are yarns of large diameter. This characteristic permits, for the latter, to have the required wiry property and for the former, to be adapted for being napped, as desired.

The long weft yarns are situated transversely to the direction of making the knitted fabric, that is, transversely to the stitch columns. All these long weft yarns extend, in the shown example, at the same side of the knit fabric, that is, when observing the FIGURE, they pass above each of the stitch loops 11*b*, 12*b* of the same stitch row. It will also be noted that in the example illustrated there is provided one long weft yarn per stitch row. These long weft yarns 14 pass under the portions 11*a* of the knit fabric yarn tying together the successive stitches of the same stitch column and further pass under the portions 12*a* tying the adjacent stitch columns to one another. This arrangement accomplishes that the yarns 14 are maintained in the place of their integration with the thus obtained knit fabric.

The inlaid warp yarns 13 are in reality deployed in a direction oblique to that of the long weft yarns, that is, in reality, in the direction of a warp yarn. This deployment takes place, in the example under consideration, obliquely to every other stitch column, but it is feasible to provide one or more inlaid warp yarns 13 above each stitch column.

The warp loom is set in such a manner that each inlaid warp yarn 13 follows a strongly undulating course in one direction substantially transversely to that of the stitch columns and passes above a plurality of stitches in each row. The warp loom is further set in a manner such that each inlaid warp yarn passes, in its undulating course, in the same manner as the long weft yarns, between the stitch loop sheet and the portions of the stitch yarns such as 11*a* and 12*a*, tying to one another respectively the consecutive stitches of the same column or two adjacent stitch columns.

The loom, however, is further set in such a manner that the undulations 13*a*, 13*b* of the yarn 13 pass above the long weft yarns 14, that is to say, the sheet constituted by the long weft yarns 14 is situated between the sheet constituted by the stitch loops of the knit fabric and the sheet constituted by the undulations 13*a*, 13*b* of the inlaid warp yarns 13.

It is to be noted that the drawing is of a schematic character permitting a better illustration of the principle of fabric structure. It has to be clarified here, however, that the weft yarns 14 have, in reality, such a cross section that they are respectively adjoining one another in the finished fabric which means that, first, the stitch loops 11*b* and 12*b* have, after tensioning the knit fabric, a length which is approximately equal to one half of the circumference of those weft yarns which they tie together in cooperation with the connecting portions 11*a*, 12*a* of the yarns 11, 12 and, second, the nappable yarns 13 which are retained by the same connecting portions 11*a*, 12*a* are constrained—by virtue of their direction which is generally transversal to the direction of the long weft yarns 14—to remain above the sheet of the adjoining joining yarns constituted by the latter and with which they are in engagement. It follows that their napping may be carried out without affecting the above-mentioned long weft yarns which are thus situated at a level which is below that of the nappable yarns.

It is to be noted at this point that the yarns 11, 12 of the knit base are relatively very thin and flexible with respect to the inlaid warp yarns 13 and that they are so selected that they are relatively smooth. The inlaid warp yarns 13, on the contrary, are structured in such a manner that they have more or less linen-like characteristics enhancing their subsequent napping. The result is that the portions of the knitted fabric yarns, such as 11*a*, 12*a*, have the tendency to sink somewhat below the upper level of the sheet of the inlaid warp yarns 13 which protects them at least in a sufficient manner, during the course of the subsequent napping or abrading operations.

It is to be noted that during the above-mentioned napping operation, the napping tools are oriented in such a manner that they work in a direction which is essentially perpendicular to the general direction of undulations of the inlaid warp yarns, that is, this action occurs longitudinally or, very slightly transversely to the direction of the portions 11*a* and 12*a* of the stitch yarns, thus avoiding, in a large measure, the napping of these yarn portions and a reduction in their resistance that could result from such napping.

In this connection it has to be further noted that, according to the method of making the napped stitch fabric according to the invention, the depth of action of the napping device which acts upon the face carrying the sheet constituted by the nappable inlaid warp yarns, is set in such a manner that the napping affects principally the inlaid warp yarns and spares those yarns which belong to the knit base fabric and, a fortiori, spares the long weft yarns the sheet of which is situated just below the former. The nappable sheet of the inlaid warp yarns 13 thus protects, during the napping operation, both the long weft yarns 14 and the sheet of the stitch yarn loops constituting the underlying part of the knit fabric.

Thus, the invention provides a fabric which is adapted to constitute reinforcing plastrons for apparel and is generally constituted by a stitch fabric and having, on the one hand, a sheet of mutually parallel reinforcing yarns giving the fabric the required wiry properties and, on the other hand, a sheet of napped yarns which gives one face of the fabric adhering properties with respect to the fabric of the apparel or to its lining and, simultaneously, a light volume effect which provides a "fuller hand" of the frontal portion of the apparel thus replacing the conventionally attached felt-like layer.

The thus constructed fabric preserves the qualities of suppleness in the warp direction and the cohesion of the base weft fabric, since the nappable yarn is, by nature, not appreciably wiry and, furthermore, it is oriented at a very substantially inclined angle with respect to the direction of the long weft yarns, so that the flexing of the fabric in the direction of warp essentially determines a torsion of the nappable yarn which, in practice, does not give rise to any appreciable elastic reaction.

The use of a stitch fabric constituted by a thin yarn for tying together the two sheets, namely that of the long weft yarns giving wiry properties and that of the inlaid warp yarns giving volume and properties of adhesion, has the further advantage that it permits the manufacture of a fabric which is thinner than the known tailor linens usually associated with a felt-like material and cost less with regard to labor, machine time input as well as known basic materials for a fabric having similar characteristics and being associated with a felt-like material.

It has to be further stressed that, on the one hand, in view of the linear speed of making the fabric on warp looms which is very substantially greater than on weaving looms of classical type for a non-knit fabric and, on the other hand, in view of the absence of technical complexities regarding the manufacturing in case of very wide fabrics and finally, in view of savings realized by the rental of premises of the shop which is generally one third of those required for weaving looms of classical type, the investment costs are very substantially less in case of a fabric made according to the invention.

It is further to be stressed that dependent upon the pattern chosen for the knit base fabric, it is feasible to provide such a fabric which has also on its other face a sheet of inserted nappable and subsequently napped yarns as it was described above.

The reinforcing fabric, an embodiment of which was described above, makes possible the mass manufacture of plastrons which do not need to be sewn on a felt-like layer to exhibit both adhering properties with regard to the fabric of the apparel and a light volume which is considered desirable for the frontal part of the apparel. It is further to be noted that the tailor linen of conventional type associated with a felt-like layer is necessarily thicker than a plastron manufactured from a fabric made according to the invention. Consequently, such conventional fabric is less adapted for the manufacture of summer apparel and also for ladies' dresses where an increased suppleness is also a desideratum.

The new reinforcing fabric according to the invention further makes possible to provide prefabricated reinforcement including, notably, a reinforcing plastron of the type described above. It is to be understood that the embodiments described above are not to be considered as limiting the scope of the invention; numerous variations are possible without departing from the scope of the invention.

Thus, for example, the yarn which is to be submitted to napping after making the fabric, could be replaced by a yarn having a contexture similar to that which the former has after the napping operation; thus, such scraping operation would be unnecessary.

The reinforcing fabric structured according to the invention may be used in every case where classical, conventional reinforcing fabrics, that is, "tailor linens" have been used. It has to be noted, however, that in view of its wiry properties at a weight that is equal to that of classical reinforcing fabrics, its use is particularly expedient in cases where, after having received on at least one of its faces a suitable adhesive product (generally applied at points or along lines) it is used as a thermo-adherent reinforcement.

I claim:

1. A warp knit fabric for use in making reinforcing plastrons for apparel comprising:

a base fabric having a sheet of relatively thin, flexible warp yarns knitted into stitches forming wales and courses, each yarn being knit alternately in separate wales which are connected by lengths of said yarn;

relatively thick, wiry weft yarns inlaid in the courses of said base fabric and lying between the stitches and the said connecting lengths of said warp yarns; and a plurality of inlaid, relatively thick and undulating warp yarns, each having a relatively roughened or napped surface and being tied to said base fabric by said connecting yarn lengths and overlying said inlaid weft yarns, each undulating warp yarn crossing a plurality of wales between succeeding undulations.

2. The fabric according to claim 1, in which the base fabric includes a second sheet of relatively thin, flexible warp yarns, each of which is knitted into stitches in a single wale only and having yarn lengths connecting adjacent stitches, said yarn lengths passing above said inlaid weft and warp yarns.

3. The method of making a napped warp knit fabric which comprises:

knitting two sheets of relatively thin, flexible warp yarns into stitches forming wales and courses, each yarn of one sheet being knit alternately in separate wales, each yarn of the other sheet being knit in a single wale only;

concurrently inlaying relatively thick, wiry weft yarns in said courses while inlaying relatively thick, nappable warp yarns in certain wales, said inlaid yarns being bound in the stitches of the knitted warp yarns by connecting lengths of said knitted yarns so that said connecting lengths are at least partially embedded in said nappable warp yarns; and subjecting the surface of the fabric containing said nappable warp yarns to a napping operation whereby a nap is raised on said nappable yarns only.

* * * * *